United States Patent [19]

Riddell

[11] Patent Number: 4,703,881

[45] Date of Patent: Nov. 3, 1987

[54] WIRE MOVEMENT SENSOR AND CONTROL FOR WIRE STITCHING MACHINE

[76] Inventor: John M. Riddell, 2826 SW. Brixton, Gresham, Oreg. 97030

[21] Appl. No.: 863,567

[22] Filed: May 15, 1986

[51] Int. Cl.[4] ..... B27F 7/17

[52] U.S. Cl. ..... 227/1; 226/48; 227/8

[58] Field of Search ..... 227/1, 8, 2; 226/48

[56] References Cited

U.S. PATENT DOCUMENTS

| | | | |
|---|---|---|---|
| 2,199,286 | 4/1940 | Fischer . | |
| 2,227,303 | 12/1940 | Flaws, Jr. . | |
| 3,120,664 | 2/1964 | Mott | 227/1 |
| 4,386,725 | 6/1983 | Chambers . | |
| 4,437,422 | 3/1984 | Torres | 112/272 |
| 4,516,713 | 5/1985 | Meijer | 227/2 |

OTHER PUBLICATIONS

United States Defensive Publication No. T958,003 to Russel et al. May 3, 1977.

*Primary Examiner*—Paul A. Bell

*Attorney, Agent, or Firm*—Klarquist, Sparkman, Campbell, Leigh & Whinston

[57] ABSTRACT

A method and apparatus for sensing wire movement through a wire stitching machine includes a sensor such as a photodetector or microswitch for sensing movement of wire through the machine and a programmable controller in communication with the sensor for stopping operation of the stitching machine if wire movement is not sensed. The sensor detects the rate of unwinding of wire from a spool that feeds the wire to the stitching machine. The programmable controller includes timers that time frequency and duration of signals from the sensor. If the sensor signals fall below a predetermined frequency or exceed a predetermined duration, the controller responds by stopping the machine and sounding an alarm. The apparatus may also include a second sensor at the diversion gate of the wire stitching machine for sensing the stoppage of wire through the machine in response to the diversion of an oversized article. If such a diversion occurs, the second sensor freezes the timers within the controller until the diversion ends.

10 Claims, 4 Drawing Figures

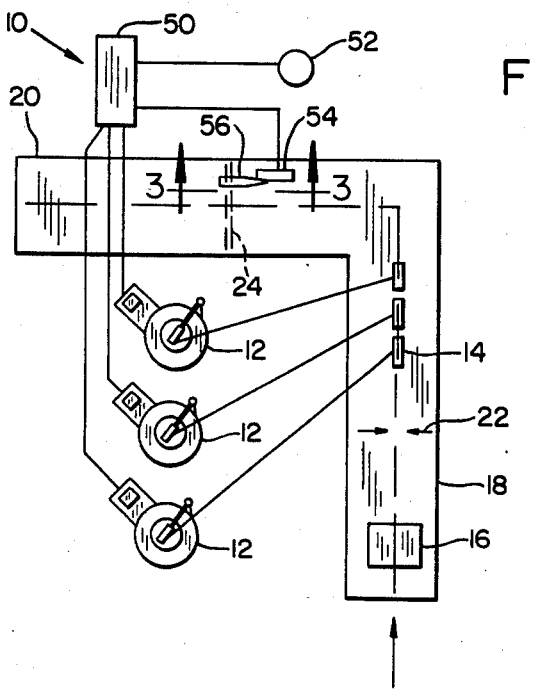
FIG. 1
FIG. 3
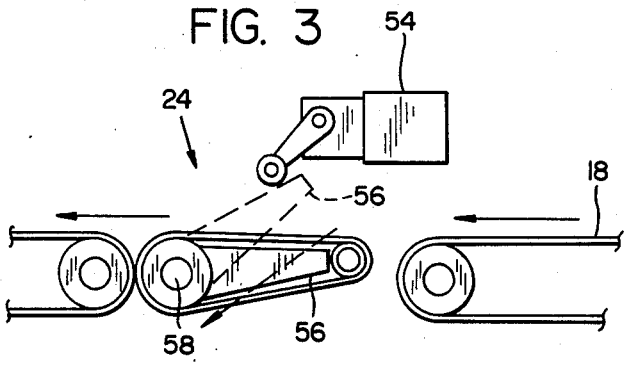
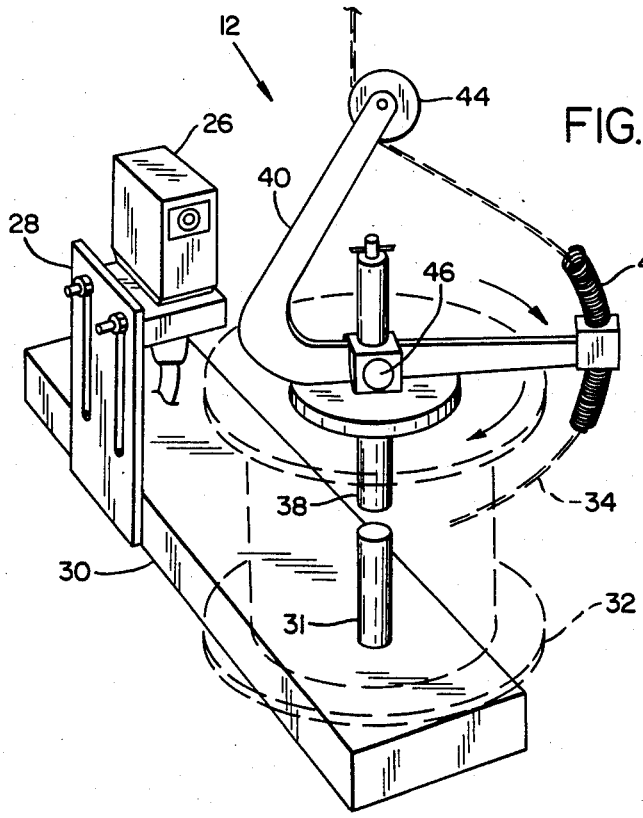
FIG. 2

WIRE MOVEMENT SENSOR AND CONTROL FOR WIRE STITCHING MACHINE

BACKGROUND OF THE INVENTION

This invention relates to wire-stitching machines that staple together catalogs, magazines, and the like. More particularly, this invention relates to a method and apparatus for sensing movement of wire through the stitching machine and, in response to the sensing, controlling the operation of stitching heads within the stitching machine.

Magazines, catalogs, and other like articles are today bound automatically by high-speed wire stitching machines. The articles are assembled from printed sheets that are dropped from spaced-apart chutes onto a conveyer to form a stack. The stack is conveyed under one or more stitching heads that drive metal staples through the center of each stack, thereby binding the stack into an article. The article is then conveyed to an automatic bundler for mailing. The complete process requires no manual assistance. A stitching machine may further include means for diverting articles that are oversized or incorrectly stacked. The oversized article is allowed to pass beneath the stitching heads without being stapled and then is diverted through a diversion gate away from the bundler.

Present stitching machines, however, lack automatic means for sensing the availability of wire for the stitching heads. Typically, the wire is pulled by the stitching head from large spools. If the wire breaks or jams, the stitching head continues to attempt to staple the article, but without success. Articles may pass through the stitching heads without being bound and onto the bundler, where the lack of staples is often not discovered until after the articles are bundled and ready for mailing.

Several attempts have been made to correct this problem, all of which have disadvantages. A simple approach is to inspect manually the articles before they are bundled for mailing, as was often done before the development of automated bundlers. But manual inspection is time consuming, costly, and unreliable.

Another approach senses whether a staple has been driven correctly through the assembled sheets of the publication, such as is disclosed in U.S. Defensive Publication No. T958,003 to Russel et al. The Russel device senses electrically the presence of the two legs of the staple driven through the article. If the sensor detects only one leg, it alerts the operator. But the device does not sense the complete absence of a staple. If wire was not fed to the stitching head, the Russel device would not sense the problem because it relies on contact with at least one staple leg to alert the operator.

A third approach senses the supply of wire at the source, such as is shown in U.S. Pat. No. 4,516,713 to Meijer. The Meijer device comprises a lever biased by a spring to press against wire coiled on a spool. When the coiled wire remaining on the spool falls below a predetermined low level, the lever disengages from the wire and activates a sensor. This sensor, however, cannot detect stoppage of the wire movement to the stitching head caused by a jam or break. Similarly, U.S. Pat. No. 2,227,303 to Flaws, Jr. discloses a wire level sensor of a different form that suffers from the same drawback.

A need, therefore, remains for a means to sense a lack of wire movement to the stitching heads and for stopping the operation of the heads when the movement ceases.

SUMMARY OF THE INVENTION

An object of the invention, therefore, is to provide an improved method and apparatus for sensing the lack of wire for stitching heads from jams, breaks, or running out.

Another object of the invention is to sense movement of wire through the stitching machine to the stitching head.

Another object of the invention is to warn the operator of the lack of wire movement.

Still another object of the invention is to stop the operation of the stitching heads if the movement of wire is no longer sensed.

To achieve these objects, a method for automatically controlling the operation of a stitching head includes sensing wire movement through the stitching machine and stopping the operation of the stitching head if wire movement is not sensed. The wire movement is most easily sensed at the wire source. The method may also include activating an alarm if movement of wire is not sensed within a predetermined time. If wire movement is still not sensed for a time after the alarm is generated, the operation of the stitching head is stopped.

An apparatus for carrying out the method includes sensing means for sensing wire movement through the stitching machine, such as at the wire source, and controller means in communication with the sensing means for stopping the operation of the stitching head. The controller means responds to signals from the sensing means to determine if the wire has stopped moving.

The wire source in a conventional stitching machine comprises a spool from which the wire is fed. The sensing means senses the rate at which the wire unwinds from the spool by generating a sensing signal each revolution of the wire from the spool. The controller means includes timers for timing the frequency and duration of the sensing signals and means for stopping the operation of the stitching head in response to the timing output.

The foregoing and other objects, features, and advantages of the invention will become more apparent from the following detailed description of a preferred embodiment which proceeds with reference to the accompanying drawings.

BRIEF DESCRIPTION OF THE DRAWINGS

FIG. 1 is a schematic diagram of a stitching machine with an apparatus according to the invention added thereto.

FIG. 2 is a view of the wire source for the stitching machine of FIG. 1 and a sensor for sensing wire movement.

FIG. 3 is a view taken along line 3—3 of FIG. 1 of a diversion gate and a sensor for sensing the position of gate.

DETAILED DESCRIPTION

Figure 4:
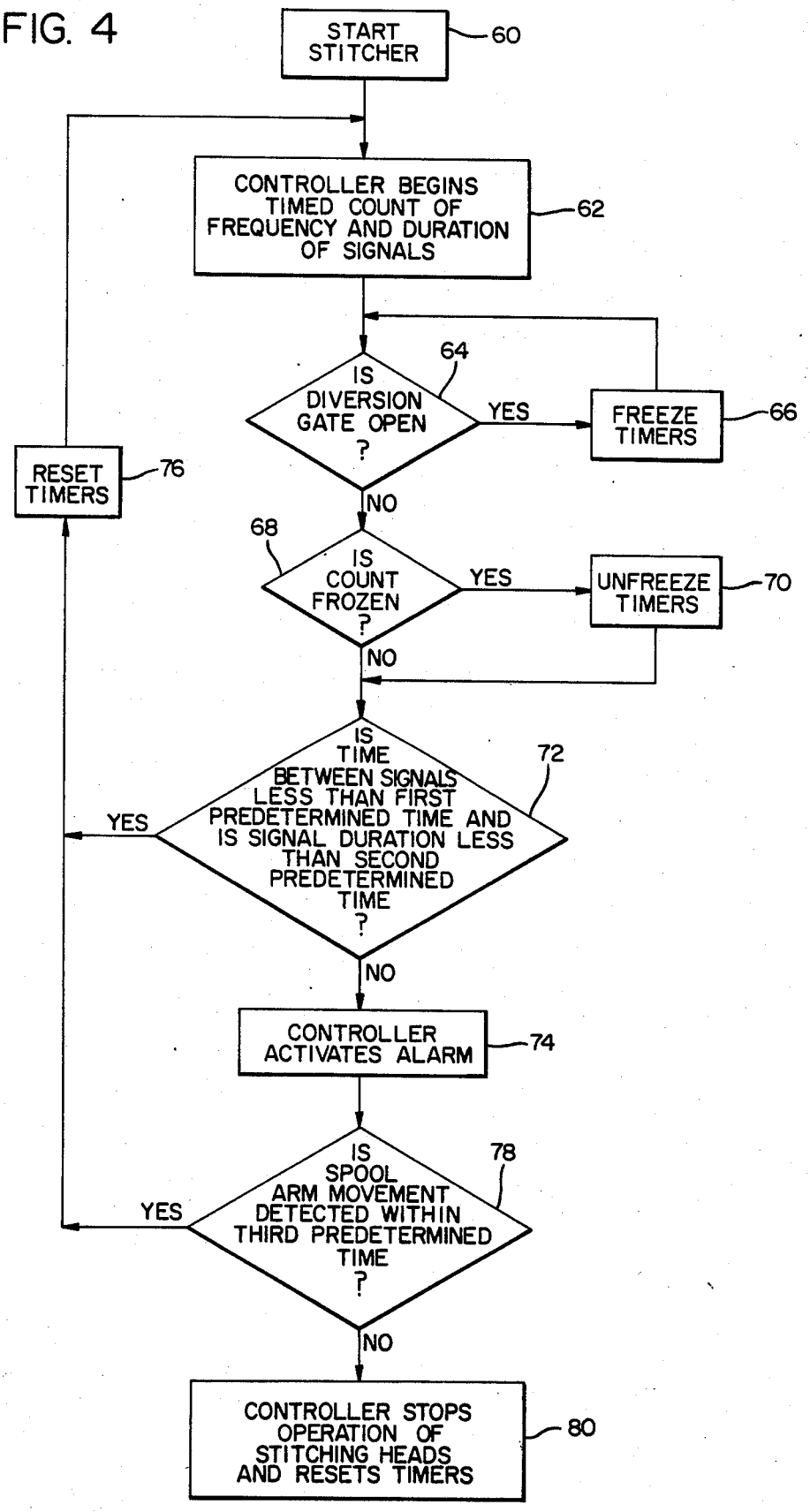
FIG. 4 is a flowchart illustrating the method of operation of the invention.

FIG. 1 is a schematic diagram including a conventional stitching machine 10, such as a type manufactured by the Muller-Martini Corporation of Hauppauge, N.Y., for stitching magazines, catalogs, and the like. The machine 10 includes one or more wire sources 12 that each feed wire to a separate stitching head 14 for stitching or stapling articles 16. These articles 16 are assembled by conventional means (not shown) along a conveyor 18 and conveyed under the heads 14 for stapling, then on to a bundling and pick-up station 20 for shipping. The machine 10 is also equipped with a caliper 22 that can be preset for monitoring the thickness of the articles 16 that are being stapled in a particular binding run. If extra sheets are inadvertently added to the article 16, for example, the article's unusual thickness will be detected by the caliper 22. Caliper 22 alerts the machine 10 to suspend the operation of stitching heads 14 and divert the oversized article through a diversion gate 24 away from the pick-up station 20.

Wire from the source 12 must be continuously fed to the head 14 for it to staple articles 16. If the wire breaks or jams in conventional stitching machines, the head 14 will continue to operate without wire and the article 16 will pass to the pick-up station 20 without being properly stapled. To prevent this, the apparatus according to the invention is added to the machine 10. Referring to FIG. 2, the apparatus includes a means for sensing movement of wire from the source 12, such as a microswitch or a photoelectric control 26 of the type manufactured by Opcon Corporation of Everett, Wash. The control 26 is shown mounted to an adjustable support 28 affixed to a base 30 that also includes a shaft 31. The shaft 31 rotatably supports the source 12, which comprises a spool 32 wound with wire 34. A rotatable wire-feed assembly axially mounted atop the spool comprises a shaft 38 for axially engaging the spool 32 and a roughly L-shaped feeder arm 40 mounted to shaft 38 for unwinding the wire 34 from the spool 32. A wire guide 42 at the horizontal end of the arm 40 guides the wire 34 as it is unwound toward a disc guide 44 at the vertical end of the arm. Affixed to the arm 40 at the shaft 38 is a retroreflector 46 for reflecting the beam of light emitted by the photoelectric control 26. The arm 40 is rotated by pull on the wire 34 from the machine 10. As the arm 40 rotates, the attached retroreflector 46 periodically reflects the light from the control 26 and the control generates a sensing signal in response.

For some machines 10, the spool 32 itself turns to feed the wire directly to the heads 14, rather than through a feeder arm 40. In such designs, the retroreflector 46 is mounted to the spool 32 itself.

Referring again to FIG. 1, the photoelectric control 26 transmits its sensing signals to a means for stopping the operation of stitching heads 14, such as a programmable controller 50 in communication with the control. In this particular embodiment, an SLC 100 programmable controller manufactured by Allen-Bradley of Milwaukee, Wis., is used, conventionally programmed according to a User's Manual provided with the controller. Other means could of course be used, such as hard-wired logic circuitry or a microcomputer. The controller 50 includes several internal timers, two of which are programmed for timing the reception of signals from the control 26. A first timer compares the time between each successive signal (the frequency) against a reference time to determine if the arm 40 is rotating. If the time between signals is greater than a first predetermined time in which the arm should make a complete revolution, say 8 seconds, the controller determines that the arm 40 has stopped moving. A second timer compares the duration of the transmitted signal against a second predetermined time, say 1.5 seconds, in case the arm 40 has stopped with the retroreflector 46 facing the control 26, causing it to transmit a continuous signal.

The controller 50 controls not only the stitching heads 14 but communicates with a conventional alarm light 52, indicated schematically in FIG. 1. Upon signals from the control 26 that the arm 40 is no longer rotating, the controller 50 activates the alarm 52 as a visual warning to the human operator that the wire 34 is no longer moving from the source 12 to the stitching head 14. This alarm lasts for a third predetermined time, say 15 seconds, sufficient for the operator to determine if, in fact, the wire is no longer moving. If the controller 50 is not manually reset or if a signal from the control 26 fails to appear within the time of the alarm 52, the controller 50 stops the operation of stitching heads 14.

As described above, the stitching machine 10 includes a caliper 22 and a diversion gate 24 for diverting oversized articles from the pick-up station 20. When the caliper 22 senses an oversized article, it suspends the operation of stitching heads 14 until the article has passed thereunder. During this suspension, the stitching machine 10 stops the movement of the wire 34 to the stitching heads 14. This lack of movement could erroneously be interpreted by the controller 50 as a wire jam or break signal and cause the controller to stop the operation of the stitching heads 14. To avoid this error, a second sensor such as a microswitch 54 is located at the diversion gate 24 to sense the gate's movement and alert the controller 50 to the cause of the wire's stoppage. Referring to FIG. 3, the switch 54 is contacted by an arm 56 that rotates upward on a shaft 58 when the diversion gate 24 opens. The microswitch 54 signals the controller 50 in response to this contact to "freeze" the timers therein. This freeze continues until the diversion gate 24 closes and causes the shaft 58 to rotate the arm 56 downward, thereby breaking its contact with the microswitch 54.

The method of operation of the invention is illustrated in the flowchart of FIG. 4. Initially, the machine 10 is started (box 60). The timers within the controller 50 are reset and begin to time the frequency and duration of signals from the control 26 (box 62). The controller 50 also communicates with the switch 54 to determine if the diversion gate 24 is open (box 64). If the gate is open, the timers are frozen (box 66), and the controller 50 continues to monitor the switch 54. Once the controller 50 determines the gate is closed, it then unfreezes the timers (boxes 68, 70), if necessary, and monitors their timing output.

If no signal from control 26 is received within the predetermined time of the first timer, or if the duration of the signal exceeds the predetermined time of the second timer (box 72), controller 50 activates the alarm 52 (box 74). On the other hand, if the signal duration and frequency indicate movement, the controller 50 resets the timers after each sensor signal (box 76) and begins the monitoring cycle again.

If the alarm 52 is activated, the controller 50 times for the third predetermined time, say 15 seconds, to give the operator a chance to respond and restore the wire movement or correct any signal error (box 78). If wire movement is detected within the third predetermined time, the controller 50 resets its timers (box 76) and begins the monitoring cycle again. However, if no movement is detected within that time frame, the controller 50 stops the operation of the heads 14 and then resets the timers (box 80).

Having illustrated and described the principles of the invention in a preferred embodiment, it should be apparent to those skilled in the art that the invention can be modified without departing from such principles. For example, other sensing means for sensing wire movement may be used than photoelectric controls or microswitches. I claim all modifications coming within the spirit and scope of the following claims.

I claim:

1. A method of automatically controlling the operation of a stitching machine, the stitching machine including a stitching head for stapling articles and a wire source including a spool wound with wire for feeding wire to the stitching head, comprising:

sensing at the spool the unwinding of wire therefrom; and stopping the operation of the stitching head if the wire unwinds from the spool at less than a predetermined rate.

2. The method of claim 1 including:

generating an alert signal when the unwinding of wire is not sensed within a predetermined time;

transmitting the alert signal to activate an alarm for a second predetermined time; and stopping the operation of the stitching head if the unwinding of wire is still not sensed within the second predetermined time.

3. An apparatus for automatically controlling the operation of a stitching machine, the stitching machine including a stitching head for stapling articles and a wire source including a spool wound with wire for feeding wire to the stitching head, comprising:

sensing means for sensing the rate at which wire unwinds from the spool; and controller means in communication with the sensing means for stopping the operation of the stitching head in response to communication from the sensing means indicating that the wire is unwinding from the spool at less than a predetermined rate.

4. The apparatus of claim 3 in which the controller means is responsive to the absence for a predetermined time of communication from the sensing means to stop the operation of the stitching head.

5. An apparatus for automatically controlling the operation of a stitching machine, the stitching machine including a stitching head for stapling articles and a wire spool for feeding wire to the stitching head, comprising:

a photoelectric control for sensing the rate at which the wire unwinds from the spool by generating a sensing signal each revolution of the spool; and controller means in communication with the photoelectric control for stopping operation of the stitching head in response to a decrease in the rate at which the photoelectric control generates sensing signals below a predetermined rate, the decreased rate indicating the wire has stopped unwinding from the spool.

6. The apparatus of claim 5 in which the controller means includes a timer for timing the frequency and duration of the sensing signals.

7. The apparatus of claim 3 further comprising alarm means in communication with the controller means for generating an alarm, the alarm means activated by the controller means in response to the sensing means.

8. The apparatus of claim 3 in which the sensing means comprises a mechanical switch.

9. An apparatus for automatically controlling the operation of a wire stitching machine, the stitching machine including a stitching head for stapling articles, a spool of wire, and a diversion device for detecting and diverting oversized articles while stopping the operation of the stitching head to allow the oversized articles to pass thereunder without stapling, the apparatus comprising:

first sensing means for sensing the frequency at which the wire unwinds from the spool, the sensing means generating a sensing signal each revolution of the wire from the spool;

controller means in communication with the first sensing means for controlling the operation of the stitching head, the controller means including a timer for timing the frequency and duration of the sensing signals and causing the controller means to stop the operation of the stitching head when the frequency of the sensing signals falls below a predetermined frequency or the duration exceeds a predetermined duration;

alarm means in communication with the controller means for generating an alarm, the alarm means activated by the controller means in response to a determination by the timer that the wire has stopped moving; and second sensing means in communication with the diversion device for sensing the diversion of an oversized article and the stoppage of the stitching head, the second sensing means generating in response to the diversion a delay signal transmitted to the timer to stop the timer until the delay signal ends, the second sensing means thereby preventing the timer from causing the controller means from stopping the operation of the stitching head.

10. The apparatus of claim 9 in which the first sensing means is a photoelectric control.

* * * * *